US010287143B2

(12) United States Patent
Harauchi et al.

(10) Patent No.: US 10,287,143 B2
(45) Date of Patent: May 14, 2019

(54) OVERHANGING STORAGE MECHANISM FOR JIB

(71) Applicant: TADANO LTD., Kagawa (JP)

(72) Inventors: Yuji Harauchi, Kagawa (JP); Yuki Hata, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 15/570,773

(22) PCT Filed: Feb. 1, 2016

(86) PCT No.: PCT/JP2016/000478
§ 371 (c)(1),
(2) Date: Oct. 31, 2017

(87) PCT Pub. No.: WO2016/194266
PCT Pub. Date: Dec. 8, 2016

(65) Prior Publication Data

US 2018/0118526 A1 May 3, 2018

(30) Foreign Application Priority Data

Jun. 5, 2015 (JP) ..... 2015-115020

(51) Int. Cl.
*B66C 23/70* (2006.01)
*B66C 23/68* (2006.01)

(52) U.S. Cl.
CPC ..... *B66C 23/70* (2013.01); *B66C 23/68* (2013.01); *B66C 23/702* (2013.01)

(58) Field of Classification Search
CPC ..... B66C 23/68; B66C 23/70; B66C 23/701–23/708
See application file for complete search history.

(56) References Cited

U.S. PATENT DOCUMENTS 3,830,376 A * 8/1974 Fritsch ..... B66C 23/702 212/350
4,222,492 A * 9/1980 Wuerflein ..... B66C 23/702 212/270

(Continued)

FOREIGN PATENT DOCUMENTS

JP S51-031270 U 3/1976
JP S63-041090 U 3/1988

(Continued)

OTHER PUBLICATIONS

Dec. 12, 2018, European Search Report issued for related EP Application No. 16802714.2.

*Primary Examiner* — Michael E Gallion
(74) *Attorney, Agent, or Firm* — Paratus Law Group, PLLC

(57) ABSTRACT

The overhanging storage mechanism for a jib is provided with: a guide roller (31) and a pin socket (45) that are provided to a jib (15); and a guide (32) and a jib-fixing pin (43) that are provided to a base end boom (14*a*). The guide (32) comprises a first raceway surface (34*s*) that pulls the jib (15) toward the bottom surface of the base end boom (14*a*) as a result of rolling of the guide roller (31), a second raceway surface (35*s*) on which the jib (15) moves along the base end boom (14*a*), and a protruding third raceway surface (36*s*) that protrudes from the second raceway surface (35*s*). The jib (15) is pulled further toward the bottom surface of the base end boom (14*a*) by rolling of the guide roller (31) on the third raceway surface (36*s*).

4 Claims, 10 Drawing Sheets

(56) References Cited

U.S. PATENT DOCUMENTS

| | | | | | |
|---|---|---|---|---|---|
| 4,483,447 | A | * | 11/1984 | Bernabe, Jr. | B66C 23/702 212/177 |
| 4,595,108 | A | * | 6/1986 | Koizumi | B66C 23/702 212/168 |
| 4,658,972 | A | * | 4/1987 | Koizumi | B66C 23/702 212/230 |
| 4,953,724 | A | * | 9/1990 | Koizumi | B66C 23/702 212/300 |
| 5,115,923 | A | * | 5/1992 | Koizumi | B66C 23/702 212/168 |
| 5,193,698 | A | * | 3/1993 | Koizumi | B66C 23/702 212/168 |

FOREIGN PATENT DOCUMENTS

| | | | |
|---|---|---|---|
| JP | H02-099890 | U | 8/1990 |
| JP | 2000-044173 | A | 2/2000 |
| JP | 2010-235250 | A | 10/2010 |

* cited by examiner

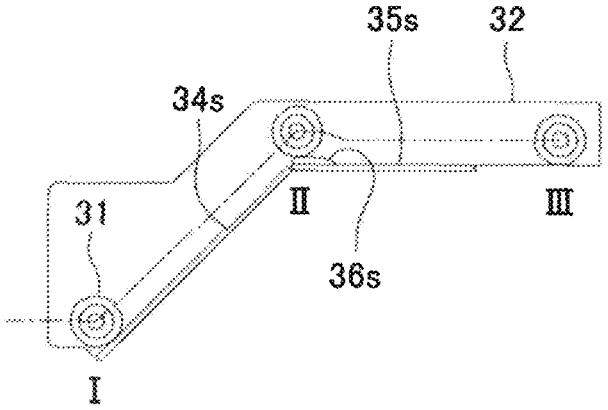
FIG. 10A
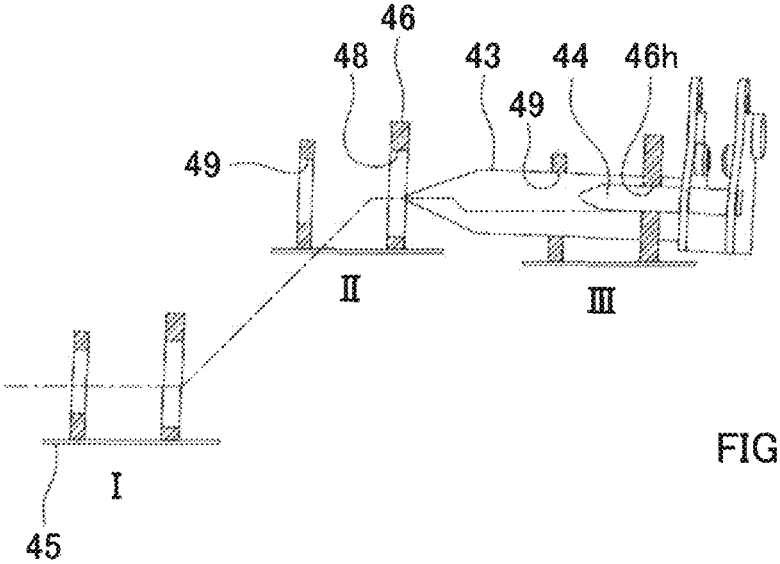
FIG. 10B
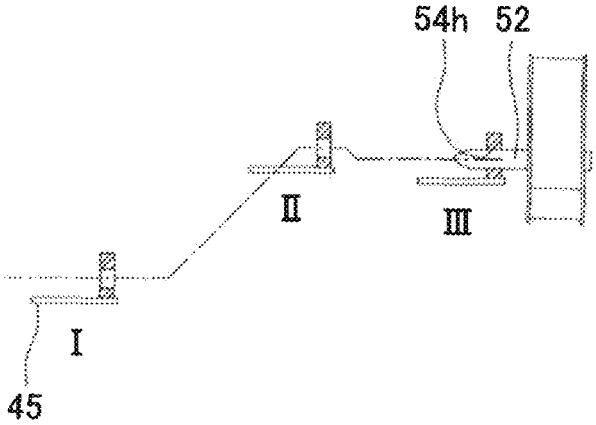
FIG. 10C
FIG. 10

OVERHANGING STORAGE MECHANISM FOR JIB

CROSS REFERENCE TO PRIOR APPLICATION

This application is a National Stage Patent Application of PCT International Patent Application No. PCT/JP2016/000478 (filed on Feb. 1, 2016) under 35 U.S.C. § 371, which claims priority to Japanese Patent Application No. 2015-115020 (filed on Jun. 5, 2015), which are all hereby incorporated by reference in their entirety.

TECHNICAL FIELD

The present invention relates to a jib overhanging storage mechanism. In more detail, the present invention relates to a jib overhanging storage mechanism used in jib overhanging/storing work.

BACKGROUND ART

PTL 1 discloses a mechanism including a guide attached to a lower part of a distal end portion side surface of a base end boom, and a guide roller attached to a substantially central portion of a jib. Further, PTL 1 discloses a mechanism including a boom side pin socket attached to a lower part of a side surface of the central portion of the base end boom, and a jib side fixing pin that is attached to a distal end portion of the jib.

In order to perform jib overhanging work, a jib base end portion and a boom distal end portion are connected first. Subsequently, a boom is raised. When the boom is slightly extended next, the jib side fixing pin is detached from the boom side pin socket. When the boom is further extended, a guide roller rolls along a sloping surface of a guide, and the jib slowly separates from a bottom surface of the base end boom. When the guide roller is completely detached from the guide, the jib is brought into a state where the jib is suspended from the boom distal end portion. Finally, tension is generated in a tension rod, and thereby the jib is overhung.

Jib storage work is performed in the reverse order of the jib overhanging work. When the boom is contracted in a state where the jib is suspended from the boom distal end portion, the guide roller rolls along the guide, and the jib is pulled toward the bottom surface of the base end boom. When the boom is further contracted, the jib side fixing pin is inserted into the boom side pin socket. Thereby, the jib can be fixed to the boom.

There is a need for applying the mechanism described in PTL 1 also to large cranes. The jib loaded on a large crane is long and has a heavy weight, and therefore has large deflection. In addition, each part has large play in a large crane. Consequently, even when the jib is pulled toward the bottom surface of the base end boom by the guide roller and the guide in jib storing work, the position of the jib side fixing pin is deviated by deflection and play. Hence, there is a problem that the jib side fixing pin cannot be inserted into the boom side pin socket, and the jib cannot be stored.

In recent years, a so-called round boom is often used in which the sectional shape of a boom bottom portion is formed in a circular arc shape for the purpose of reducing the weight and increasing rigidity (for example, PTL 2). In a round boom, which is weaker to constrain rotation than the booms having quadrangular and hexagonal sectional shapes, the distal end boom easily rotates with respect to the base end boom. The position of the jib side fixing pin is also deviated by the rotation, so that the jib side fixing pin cannot be inserted into the boom side pin socket.

CITATION LIST

Patent Literature

PTL 1
Japanese Patent Application Laid-Open No. 200044173
PTL 2
Japanese Patent Application Laid-Open No. 2010-235250

SUMMARY OF INVENTION

Technical Problem

In the light of the above described circumstances, an object of the present invention is to provide a jib overhanging storage mechanism with which a jib can be stored even if deflection or the like occurs to the jib during jib storing work.

Solution to Problem

A jib overhanging storage mechanism according to a first aspect of the invention is a mechanism for overhanging/storing a jib with respect to a boom having a base end boom, the mechanism including: a guide roller that is provided at the jib or the base end boom; a guide that is provided at the base end boom or the jib, and guides the guide roller; a jib fixing pin that is provided at the base end boom or the jib; and a pin socket that is provided at the jib or the base end boom, and has an insertion hole into which the jib fixing pin can be inserted, in which: the guide has a first raceway surface, a second raceway surface and a third raceway surface on which the guide roller rolls; the first raceway surface is shaped such that the jib is pulled toward a bottom surface of the base end boom by the Guide roller rolling thereon with contraction of the boom; the second raceway surface is shaped such that the jib moves along the base end boom in a state where the jib is pulled toward the bottom surface of the base end boom by the guide roller thereon with contraction of the boom; and the third raceway surface is in a protruded shape protruded from the second raceway surface.

The jib overhanging storage mechanism according to a second aspect of the invention is the mechanism according to the first aspect, in which the jib fixing pin has a distal end portion formed in a conical shape; and the third raceway surface is located in a position where the guide roller passes before and after an apex of the distal end portion of the jib fixing pin passes through a front end opening portion of the insertion hole, with contraction of the boom.

The jib overhanging storage mechanism according to a third aspect of the invention is the mechanism according to the first or the second aspect, in which the third raceway surface is a surface of a correction plate that is placed on the second raceway surface, The jib overhanging storage mechanism according to a fourth aspect of the invention is the mechanism according to the first, the second or the third aspect, in which: an inside dimension of a front end opening portion of the insertion hole is larger than an outside dimension of the jib fixing pin; and an inside dimension of a rear end opening portion of the insertion hole is substantially a same as the outside dimension of the jib fixing pin.

Advantageous Effects of Invention

According to the first aspect of the invention, in the jib storing work, the guide roller rolls on the third raceway surface, and thereby the jib is further pulled toward the bottom surface of the base end boom, so that even if deflection or the like occurs to the jib, a positional deviation of the jib fixing pin and the insertion hole can be corrected. Consequently, the jib fixing pin can be inserted into the insertion hole, and the jib can be stored.

According to the second aspect of the invention, the degree of pulling the jib is returned to a normal state, after the apex of the distal end portion of the jib fixing pin passes through the front end opening portion of the insertion hole, so that the jib fixing pin and the pin socket can be prevented from interfering with each other and exerting an excessively large load.

According to the third aspect of the invention, the correction plate can be only placed on the second raceway surface, so that manufacture is facilitated.

According to the fourth aspect of the invention, the inside dimension of the front end opening portion of the insertion hole is larger than the outside dimension of the fixing pin, so that the positional deviation between the jib fixing pin and the insertion hole is absorbed, and the jib fixing pin can be inserted into the insertion hole. Further, the inside dimension of the rear end opening portion of the insertion hole is substantially the same as the outside dimension of the jib fixing pin, so that in the state where the jib fixing pin is completely inserted into the insertion hole, the jib fixing pin can be positioned.

BRIEF DESCRIPTION OF DRAWINGS

FIGS. 10A to 10C are a side view of guide member 30, first jib support member 40 and second jib support member 50 illustrating the respective steps of the jib storing work.

DESCRIPTION OF EMBODIMENTS

Next, embodiments of the present invention will be described based on the accompanying drawings.

Figure 1:
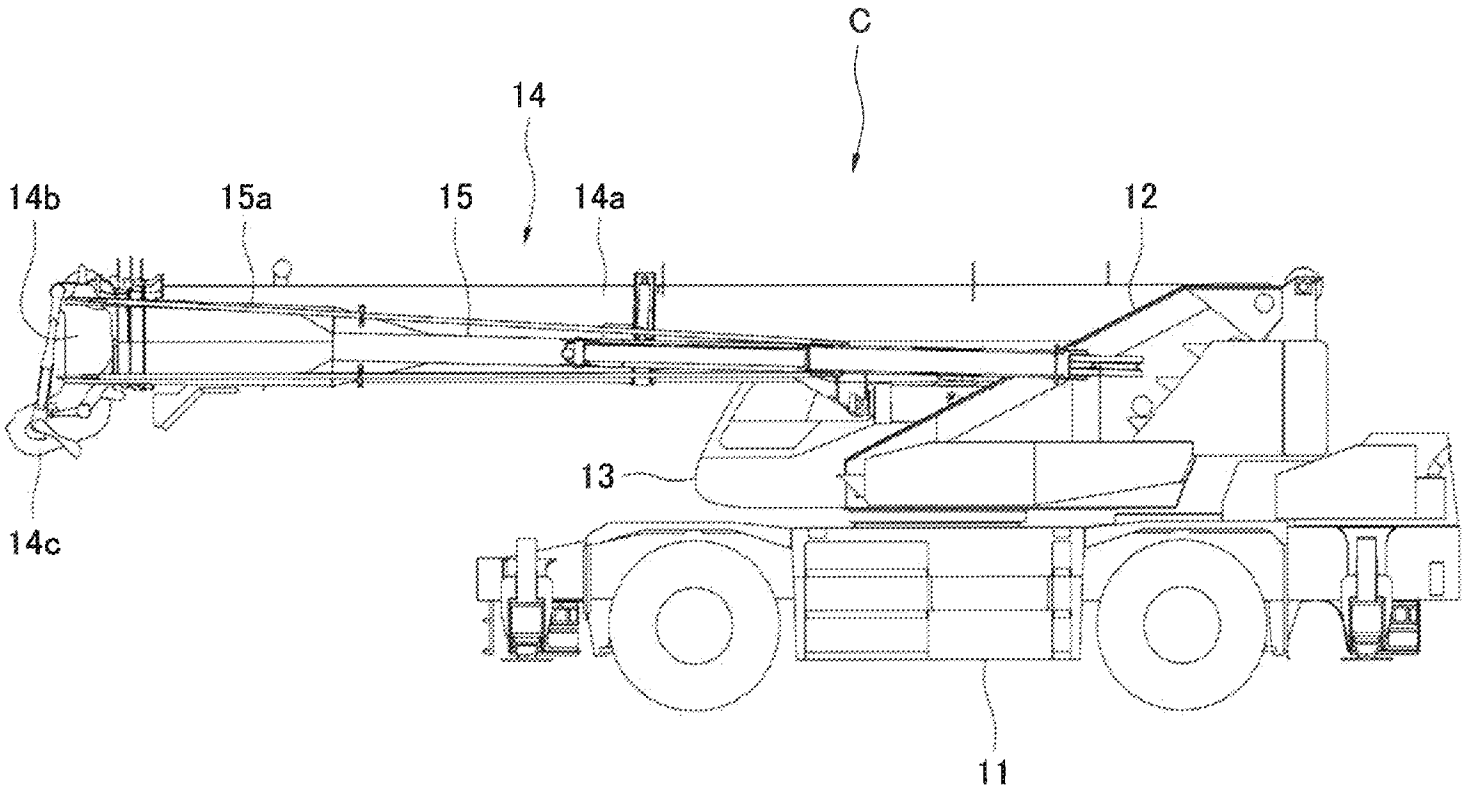
FIG. 1 is a side view of mobile crane C in a state where jib 15 is stored.

A jib overhanging storage mechanism according to one embodiment of the present invention is applied to mobile crane C illustrated in FIG. 1, for example. The jib overhanging storage mechanism of the present embodiment can be applied to various cranes, without being limited to mobile crane C illustrated in FIG. 1.

(Mobile Crane)

First, a basic structure of mobile crane C will be described.

Reference sign 11 in FIG. 1 designates a travelling vehicle body, which is equipped with wheels for travelling. Rotating platform 12 is loaded on travelling vehicle body 11, and can rotate 360° within a horizontal plane by a rotating motor. Driver's cab 13 is provided on rotating platform 12.

Boom 14 is attached to rotating platform 12 to be capable of hoisting and lowering. A base end portion of boom 14 is pivotally supported by rotating platform 12 with a pin. A hoisting and lowering cylinder is attached to between boom 14 and rotating platform 12. When the hoisting and lowering cylinder is extended, boom 14 is raised, whereas when the hoisting and lowering cylinder is contracted, boom 14 is lowered.

Boom 14 is a multistage boom constructed in a telescopic manner, and includes base end boom 14*a*, an intermediate boom and distal end boom 14*b*. Boom 14 extends/contracts by an extending/contracting cylinder. The number of stages of boom 14 is not specially limited. Boom 14 may be of a two-stage type without an intermediate boom, or may have the configuration with four stages or more including a plurality of intermediate booms.

Boom 14 of the present embodiment is a so-called round boom in which a sectional shape of a bottom portion is formed in a circular-arc shape. Accordingly, distal end boom 14*b* has a property of being easy to rotate around a center axis with respect to base end boom 14*a*. Booms having quadrangular and hexagonal sectional shapes may be used.

From distal end portion 14*c* of boom 14 (distal end boom 14*b*), a wire rope equipped with a hook not illustrated is suspended, and the wire rope is guided to rotating platform 12 along boons 14 to be wound on a winch. The winch rotates in forward and reverse directions by drive of a hoist motor, winds up the wire rope and pulls it out, and thereby can raise and lower the hook.

By combining rotation of rotating platform 12, hoisting and lowering and extension and contraction of boom 14, and raising and lowering of the hook, loading and unloading in a three-dimensional space are enabled.

Mobile crane C is equipped with jib 15. Jib 15 is an elongated rod-shaped member as a whole, and base end portion 15*a* thereof is in a bifurcated shape. Jib 15 is used when a lining range/operation radius larger than a lifting range/operation radius with a boom length of boom 14 which is fully extended is obtained. When not in use, jib 15 is stored along a side surface of boom 14 (see FIG. 1). When in use, base end portion 15*a* of jib 15 and distal end portion 14*c* of boom 14 are connected, and jib 15 is overhung forward of boom 14 (see FIG. 8).

(Jib Connection Structure)

Next, a jib connection structure will be described.

Figure 2:
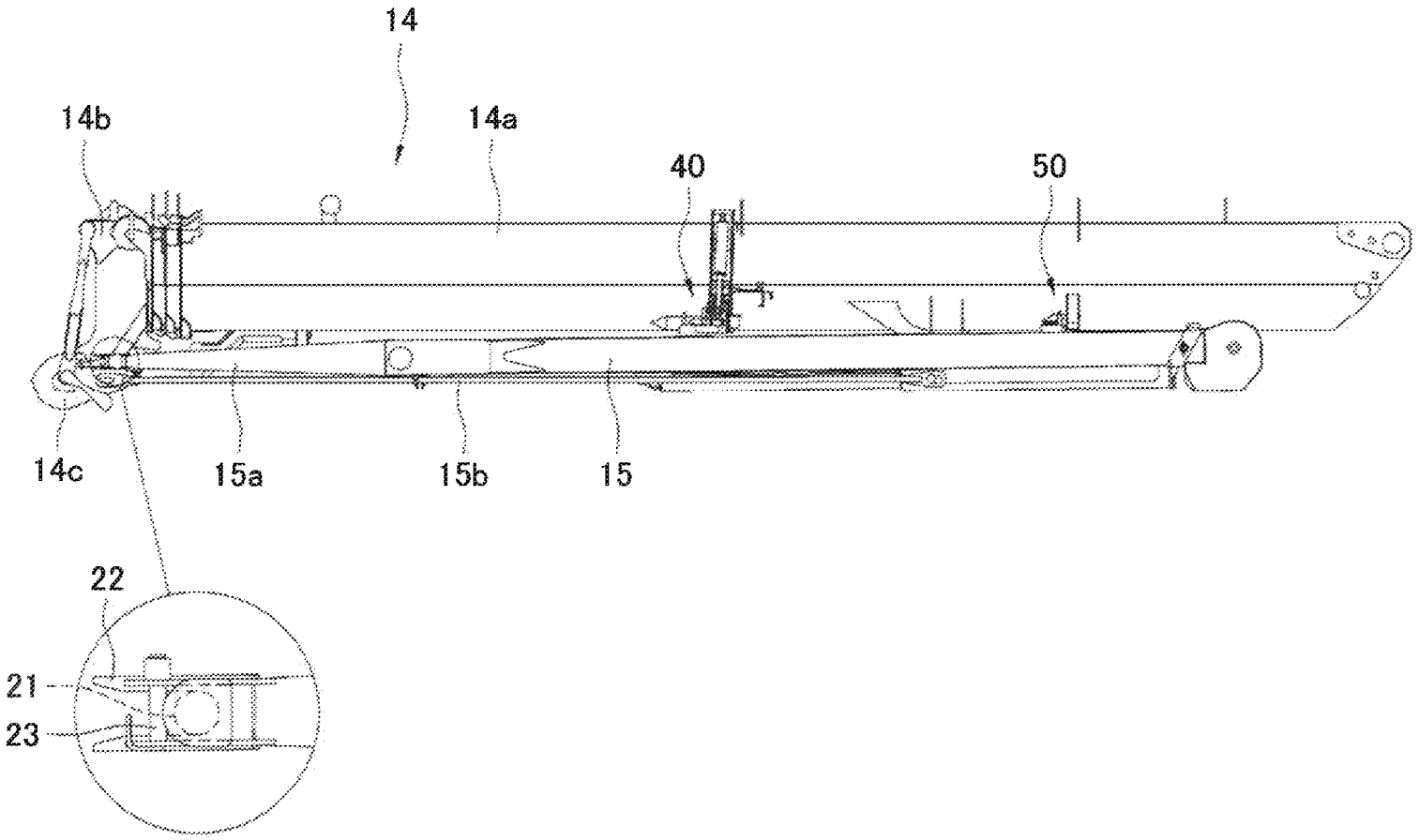
FIG. 2 is a left side view of jib 15 and boom 14 in a state where jib 15 is disposed in a lower hanging position of boom 14.
Figure 3:
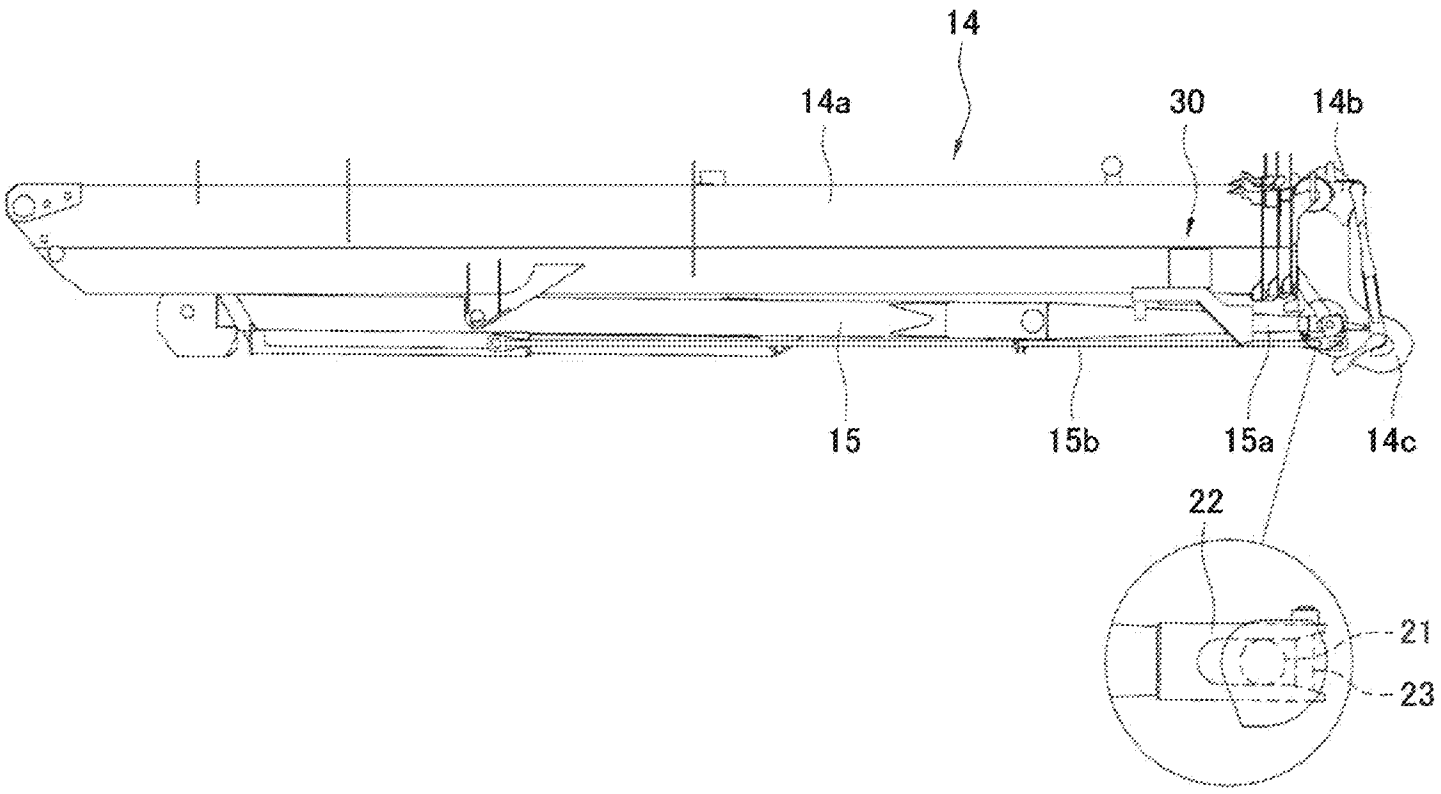
FIG. 3 is a right side view of jib 15 and boom 14 in the state where jib 15 is disposed in the lower hanging position of boom 14.
Figure 4:
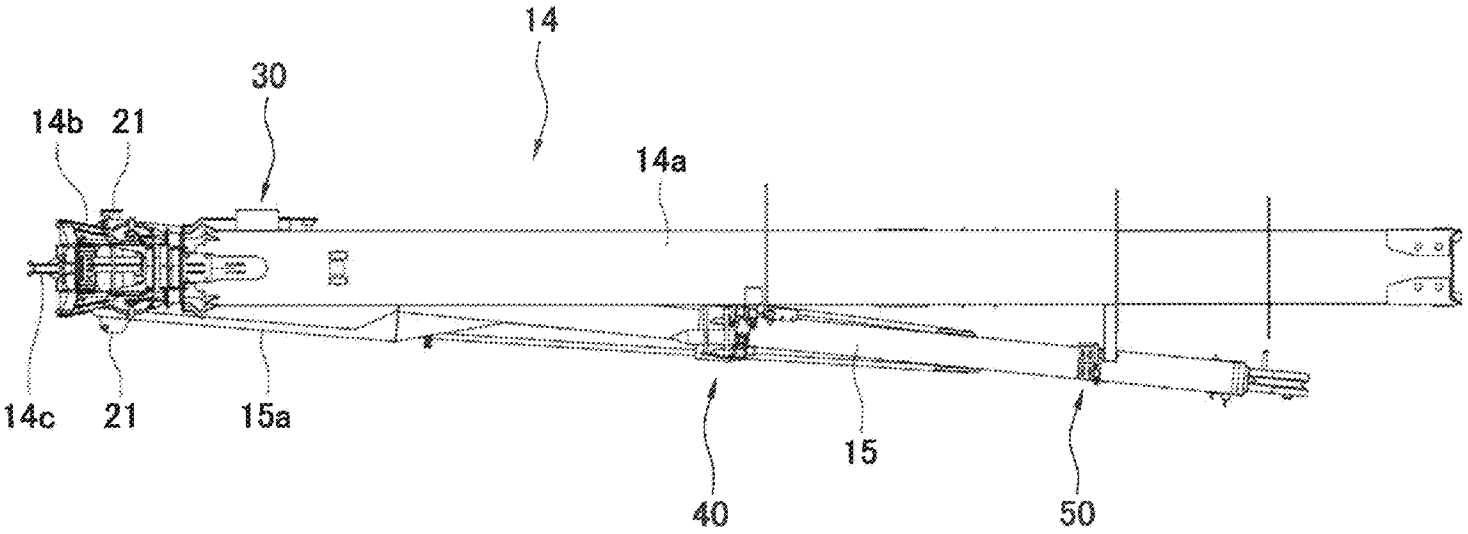
FIG. 4 is a plan view of jib 15 and boom 14 in the state where jib 15 is disposed in the lower hanging position of boom 14.

FIGS. 2, 3 and 4 are a left side view, a right side view and a plan view of a state where jib 15 is disposed in a lower hanging position along a bottom surface of base end boom 14*a*. As will be described later, in jib overhanging/storing work, connection/disconnection of boom distal end portion 14*c* and jib base end portion 15*a* is performed in the state where jib 15 is disposed in the lower hanging position.

As illustrated in FIG. 4, in the state where jib 15 is disposed in the lower hanging position, jib base end portion 15*a* is located at boom distal end portion 14*c*, and a distal end portion of jib 15 is in an offset disposition in which the distal end portion is located sideward of boom 14. The distal end portion of jib 15 is located at an opposite side of driver's cab 13 with respect to boom 14. Hereinafter, a side at which the distal end portion of jib 15 is located in the offset disposition will be referred to as a left side, and an opposite side to the left side (driver's cab 13 side) will be referred to as a right side. However, an embodiment in which the left and the right are reversed may be adopted.

Boom distal end portion 14*c* is provided with jib connection shafts 21 and 21 that overhang horizontally at both sides thereof. As illustrated in FIGS. 2 and 3, jib base end engagement portions 22 and 22 are provided at respective end portions of jib base end portion 15*a* in the bifurcated shape.

Jib base end engagement portion 22 is formed in a U-shape, and allows jib connection shaft 21 to be fitted therein. Further, an insertion hole is formed in a distal end portion of jib base end engagement portion 22. Jib connection shaft 21 is fitted in jib base end engagement portion 22, and pin 23 is inserted into the insertion hole, whereby jib connection shaft 21 is prevented from being disengaged. Thereby, jib base end engagement portion 22 and jib connection shaft 21 can be connected.

(Jib Overhanging Storage Mechanism)

Next, a jib overhanging storage mechanism of the present embodiment will be described.

The jib overhanging storage mechanism of the present embodiment is a mechanism for overhanging/storing jib 15 with respect to boom 14 in mobile crane C as described above. The jib overhanging storage mechanism includes guide member 30, first jib support member 40 and second jib support member 50. Guide member 30 is provided at a right side of boom 14. First jib support member 40 and second jib support member 50 are provided at a left side of boom 14. Hereinafter, the respective members will be described in order.

(Guide Member 30)

Figure 5:
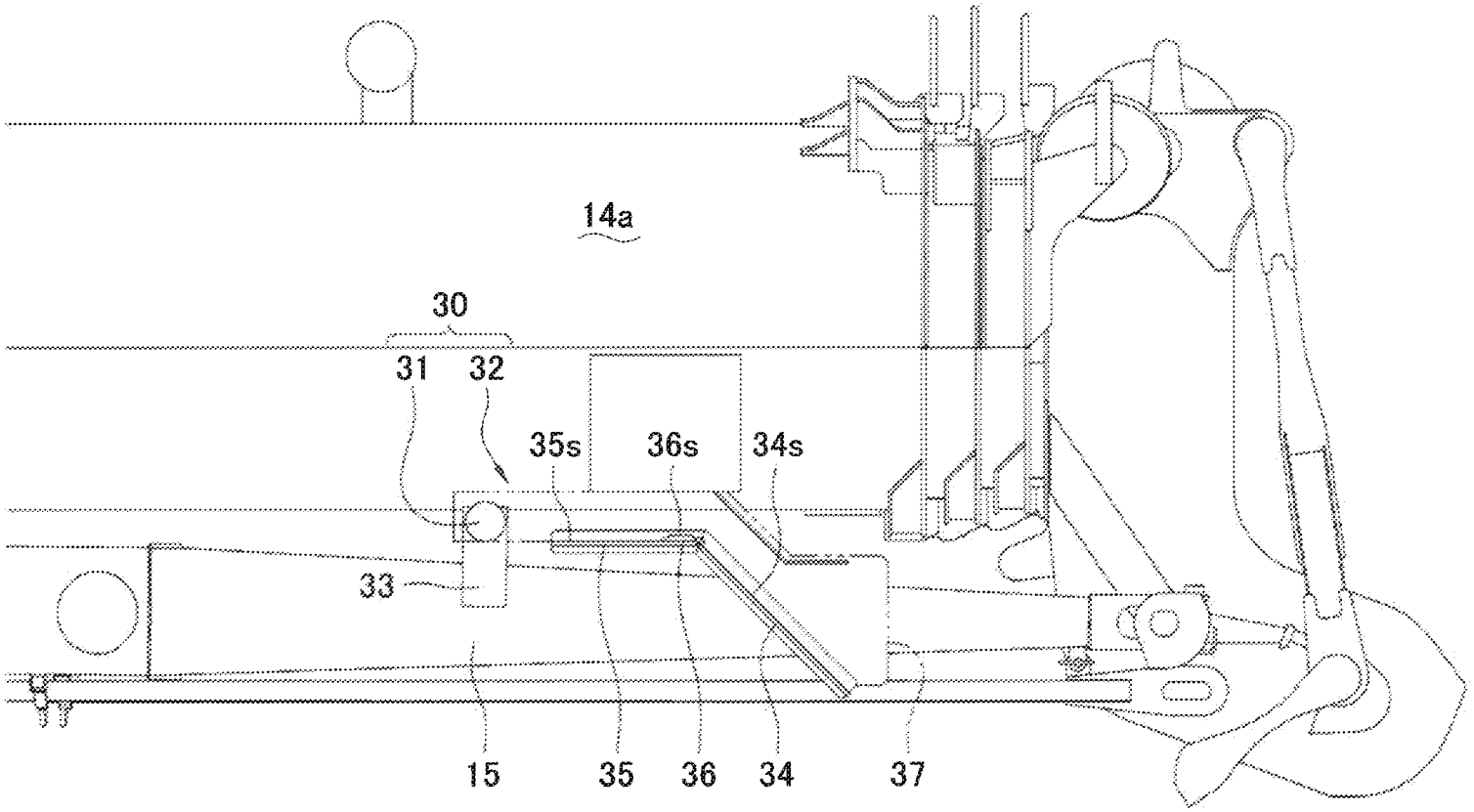
FIG. 5 is a side view of guide member 30.

Guide member 30 is a member for guiding a posture of jib 15, with extension and contraction of boom 14, in jib overhanging/storing work. As illustrated in FIG. 5, guide member 30 includes guide roller 31, and guide 32 that guides guide roller 31.

An arm 33 protruded to a bottom surface side is provided on a base end portion side surface of jib 15. Guide roller 31 is rotatably provided at a distal end portion of arm 33. In FIG. 5, jib 15 is disposed in a state where a bottom surface thereof faces base end boom 14*a*.

Guide 32 is provided on a distal end portion side surface of base end boom 14*a* in a state where the guide 32 is protruded to the bottom surface side. Guide 32 has first raceway track member 34, second raceway track member 35 and correction plate 36. An alternate long and short dash line in FIG. 5 shows side wall 37 constructing guide 32.

Side wall 37 serves to support first raceway track member 34 and second raceway track member 35, and to restrict movement in a lateral direction (direction perpendicular to the paper surface) of guide roller 31. For convenience of explanation, only an outer shape of side wall 37 is shown by the alternate long and short dash line.

A surface of first raceway track member 34 is referred to as first raceway surface 34*s*, a surface of second raceway track member 35 is referred to as second raceway surface 35*s*, and a surface of correction plate 36 is referred to as third raceway surface 36*s*. Jib 15 is guided by Guide roller 31 rolling on raceway surfaces 34*s*, 35*s* and 36*s*.

First raceway surface 34*s* has an inclination to a top surface from a bottom surface of boom 14 toward the base end from a distal end of boom 14. Consequently, as will be described later, guide roller 31 rolls on first raceway surface 34*s* with extension of boom 14 in the jib overhanging work, whereby jib 15 is separated from the bottom surface of base end boom 14*a*. Further, in the jib storing work, guide roller 31 rolls on first raceway surface 34*s* with contraction of boom 14, whereby jib 15 is pulled toward the bottom surface of base end boom 14*a*.

Second raceway surface 35*s* is parallel with a center axis of boom 14, and is connected to a base end side end portion of first raceway surface 34*s*. Consequently, as will be described later, in the jib overhanging/storing work, guide roller 31 rolls on second raceway surface 35*s* with extension and contraction of boom 14, and thereby jib 15 moves along base end boom 14*a* in a state where jib 15 is pulled toward the bottom surface of base end boom 14*a*.

Third raceway surface 36*s* is in a protruded shape protruded from second raceway surface 35*s*. Consequently, as will be described later, in the jib overhanging/storing work, guide roller 31 rolls on third raceway surface 36*s* with extension and contraction of boom 14, and thereby jib 15 is further pulled toward the bottom surface of base end boom 14*a*.

While in the present embodiment, the configuration in which correction plate 36 is placed on second raceway surface 35*s* is adopted, third raceway surface 36*s* may be formed with second raceway surface 35*s* by bending second raceway track member 35 by pressing, instead of the configuration. However, use of correction plate 36 makes manufacture easier because correction plate 36 is only placed on second raceway surface 35*s*. In addition, higher strength is obtained than in the case of pressing.

While in the present embodiment, guide roller 31 is provided at jib 15, and guide 32 is provided at base end boom 14*a*, guide roller 31 may be provided at base end boom 14*a*, and guide 32 may be provided at jib 15 instead of this.

(First Jib Support Member 40)

First jib support member 40 is a member for supporting jib 15 in a stored state. Further, first jib support member 40 has a function of rotating jib 15 between a storage position along the side surface of boom 14 and the lower hanging position.

Figure 6:
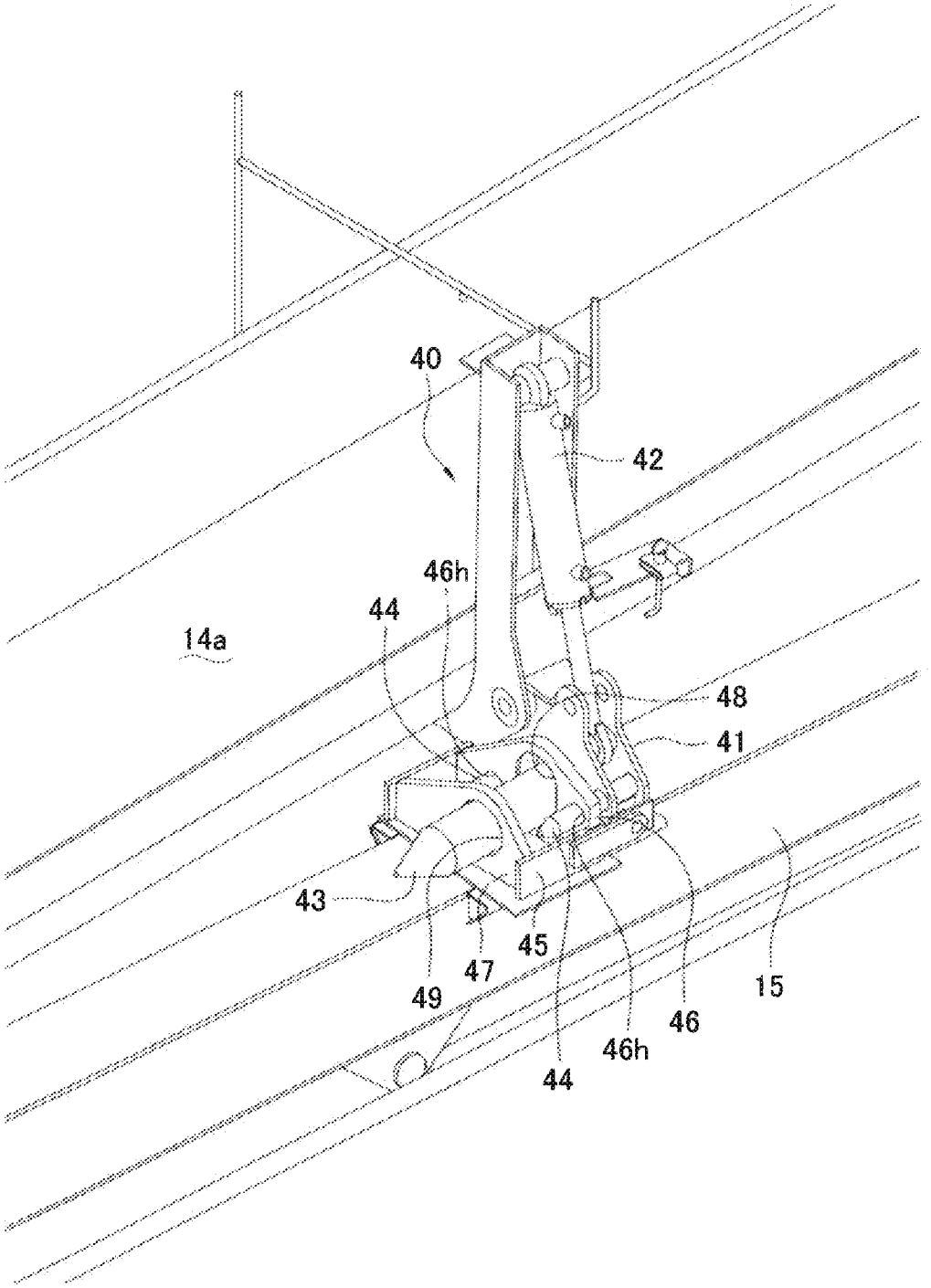
FIG. 6 is a perspective view of first jib support member 40.

As illustrated in FIG. 6, bracket 41 is pivotally supported on a bottom portion side surface in a substantially center of base end boom 14*a*. Hydraulic cylinder 42 is attached to between an upper portion side surface of base end boom 14*a* and bracket 41. By extension and contraction of hydraulic cylinder 42, bracket 41 rotates with respect to base end boom 14*a*.

Bracket 41 is provided with jib fixing pin 43. Jib fixing pin 43 is in a columnar shape, and a distal end portion thereof is formed into a conical shape. Jib fixing pin 43 is parallel with the center axis of boom 14, and is disposed with a distal end portion thereof directed to the distal end of boom 14. Jib fixing pin 43 may be disposed parallel with a center axis of jib 15.

Bracket 41 is provided with two first auxiliary pins 44 and 44, besides jib fixing pin 43. First auxiliary pin 44 is in a circular column shape with a smaller diameter and a shorter length than jib fixing pin 43, and a distal end portion thereof is formed into a conical shape. First auxiliary pin 44 is parallel with the center axis of boom 14, and is disposed with a distal end portion thereof directed to the distal end of boom 14. First auxiliary pin 44 may be disposed parallel with the center axis of jib 15.

A pin socket 45 is provided on a bottom surface in a substantially center of jib 15. In FIG. 6, jib 15 is disposed with a bottom surface thereof facing base end boom 14*a*. Pin socket 45 has front end rib 46 and rear end rib 47. Front end rib 46 has front end insertion hole 48 formed therein, and rear end rib 47 has rear end insertion hole 49 formed therein. Jib fixing pin 43 is capable of being inserted into front end insertion hole 48 and rear end insertion hole 49. Front end insertion hole 48 and rear end insertion hole 49 are disposed in such a manner that center axes thereof are parallel with the center axis of boom 14 in a state where jib 15 is pulled toward the bottom surface of base end boom 14*a*. In front end rib 46, first auxiliary insertion hole 46*h* in which first auxiliary pin 44 is capable of being inserted is formed. Front end insertion hole 48 and rear end insertion hole 49 may be disposed in such a manner that center axes thereof are parallel with the center axis of jib 15.

Front end insertion hole 48 and rear end insertion hole 49 correspond to "insertion hole" described in the claims. Front end insertion hole 48 configures a front end opening portion of the insertion hole, and rear end insertion hole 49 configures a rear end opening portion of the insertion hole. Here, in the jib storing work, a part into which jib fixing pin 43 is inserted first is set as a "front end", and a part into which jib fixing pin 43 is inserted later is set as a "rear end".

Front end insertion hole 48 is a vertical hole. In more detail, front end insertion hole 48 is a vertical hole along a vertical direction (a direction toward the top surface from the bottom surface) of boom 14 in the state where jib 15 is pulled toward the bottom surface of base end boom 14*a*. When jib 15 deflects by weight, pin socket 45 goes down with respect to jib fixing pin 43. Further, jib fixing pin 43 and pin socket 45 are disposed sideward of base end boom 14*a*. Consequently, when distal end boom 14*b* rotates with respect to base end boom 14*a* by the weight of jib 15 and the like, pin socket 45 goes down with respect to jib fixing pin 43. In short, positions of jib fixing pin 43 and pin socket 45 deviate in the vertical direction due to deflection of jib 15 and the like. Front end insertion hole 48 is a long hole along the deviation direction.

Rear end insertion hole 49 is a round hole, and an inside diameter thereof is substantially the same as an outside diameter of jib fixing pin 43. Here, "substantially the same" includes not only a case where the inside diameter of rear end insertion hole 49 is the same as the outside diameter of jib fixing pin 43, but also a case where the inside diameter of rear end insertion hole 49 is slightly larger than the outside diameter of jib fixing pin 43. Note that an "inside dimension" described in the claims includes the inside diameter, and an "outside dimension" includes the outside diameter.

Front end insertion hole 48 may be a round hole and may have an inside diameter made larger than the outside diameter of jib fixing pin 43 instead of being formed into a vertical hole. In short, a center axis of jib fixing pin 43 may deviate from a center axis of front end insertion hole 48, if front end insertion hole 48 has enough room for jib fixing pin 43 to be inserted therein.

Jib fixing pin 43 is not limited to a circular column shape, but may be a rectangular column shape. In this case, the distal end portion of jib fixing pin 43 may be formed in a pyramid shape. Further, front end insertion hole 48 and rear end insertion hole 49 may be formed as square holes. An inside dimension of front end insertion hole 48 is made larger than an outside dimension of jib fixing pin 43, and an inside dimension of rear end insertion hole 49 may be made substantially the same as an outside dimension of fixing pin 43.

The insertion holes for jib fixing pin 43 may be formed as a single insertion hole instead of a component including front end insertion hole 48 and rear end insertion hole 49. In this case, an inside dimension of a front end opening portion of the insertion hole can be made larger than the outside dimension of jib fixing pin 43, and an inside dimension of a rear end opening portion may be made substantially the same as the outside dimension of jib fixing pin 43. The front end opening portion and the rear end opening portion may be configured to be continuously connected. Here, at jib storing work, of the opening portions at both ends of the insertion hole, the opening portion into which jib fixing pin 43 is inserted is set as the "front end opening portion", and the opening portion from which the distal end of jib fixing pin 43 protrudes is set as the "rear end opening portion".

While in the present embodiment, jib fixing pin 43 is provided at base end boom 14*a*, and pin socket 45 is provided at jib 15, instead of this, jib fixing pin 43 may be provided at jib 15, and pin socket 45 may be provided at base end boom 14*a*.

(Second Jib Support Member 50)

Figure 7:
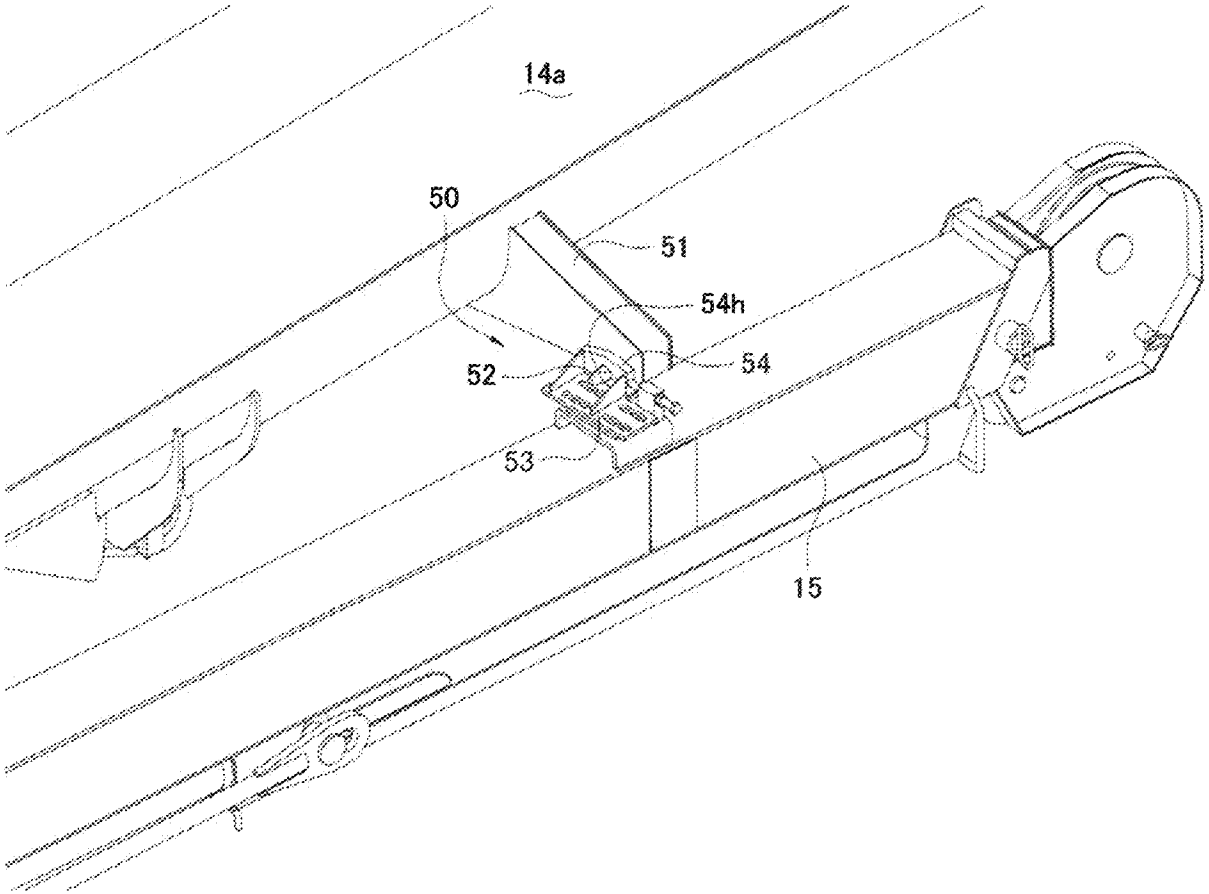
FIG. 7 is a perspective view of second jib support member 50.

Second jib support member 50 is a member for supporting jib 15 in the stored state. As illustrated in FIG. 7, arm 51 is provided at a bottom surface side portion in a base end portion of base end boom 14*a*. Second auxiliary pin 52 is provided at a distal end portion of arm 51. Second auxiliary pin 52 is in a circular column shape with a small diameter and a short length, and a distal end portion thereof is formed in a conical shape. Second auxiliary pin 52 is parallel with the center axis of boom 14, and the distal end portion thereof is disposed to be directed to the distal end of boom 14.

At the distal end portion of jib 15, second pin socket 53 is provided on a bottom surface. In FIG. 7, jib 15 is disposed in a state where a bottom surface thereof faces base end boom 14*a*. Second pin socket 53 has rib 54. In rib 54, second auxiliary insertion hole 54*h* into which second auxiliary pin 52 can be inserted is formed.

(Jib Storing Work)

Next, jib storing work will be described.

Figure 8:
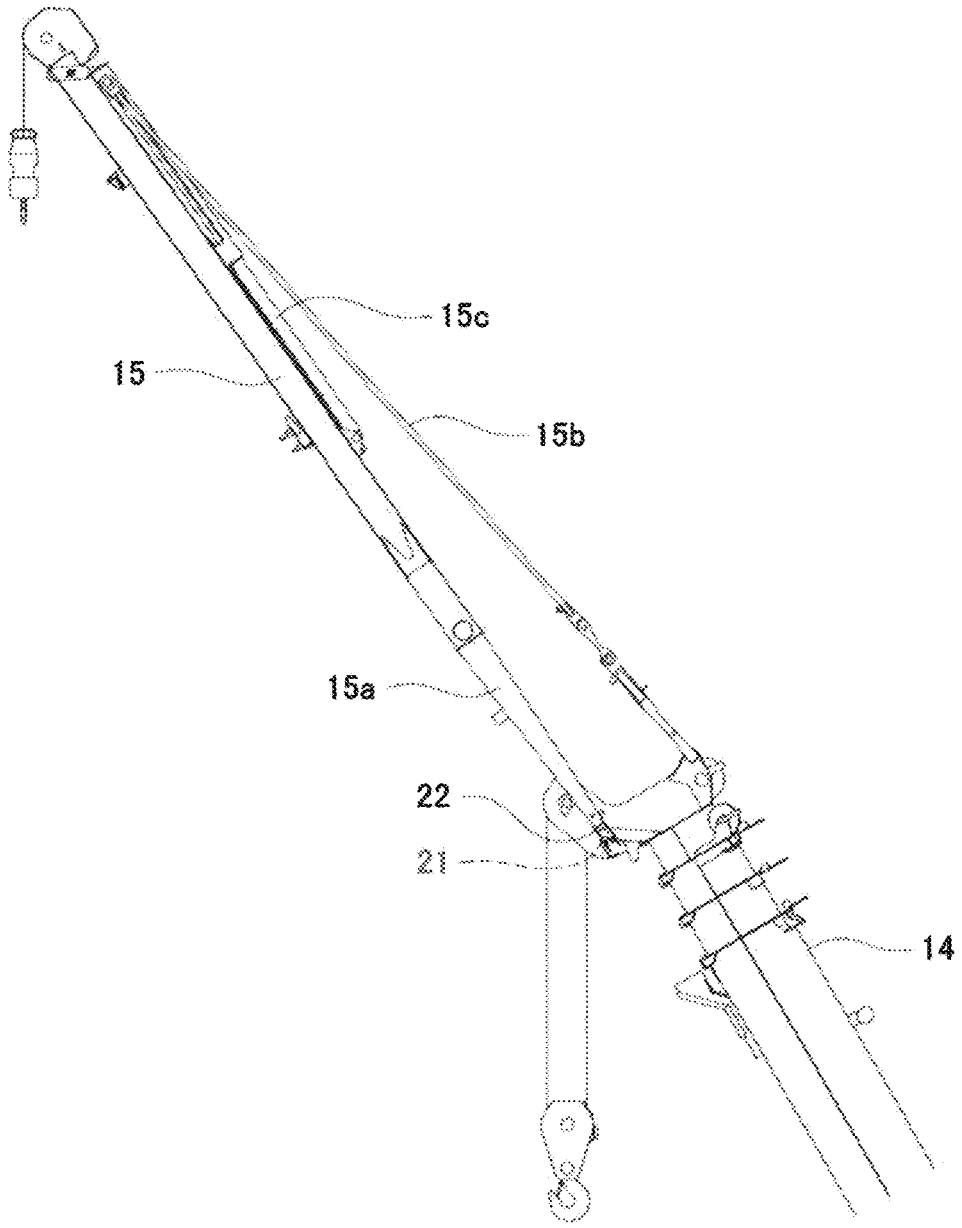
FIG. 8 is a side view of a state where jib 15 is overhung.

(1) As illustrated in FIG. 8, in the state where jib 15 is overhung, jib 15 is substantially in line with boom 14.

(2) Tilt cylinder 15*c* is mounted on jib 15. A rod of tilt cylinder 15*c* is connected to tension rod 15*b*. Tension of tension rod 15*b* is loosened by contracting tilt cylinder 15*c*. Thereupon, as illustrated in FIG. 9A, jib 15 rotates forward with jib connection shaft 21 as center, and is brought into a state where jib 15 is suspended from boom distal end portion 14*c*.

Figure 9C:
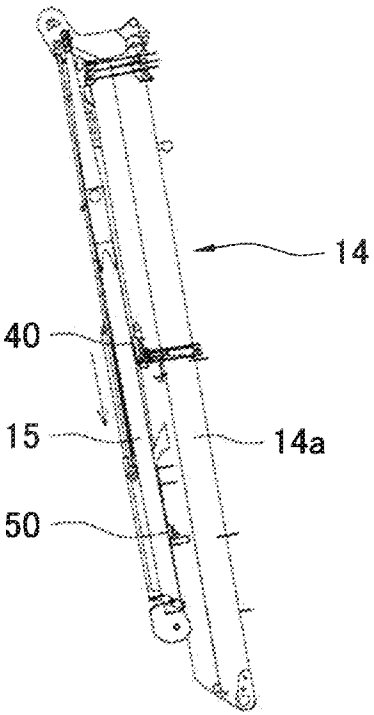
FIGS. 9A to 9C are a side view of jib 15 and boom 14 illustrating respective steps of jib storing work.
Figure 9B:
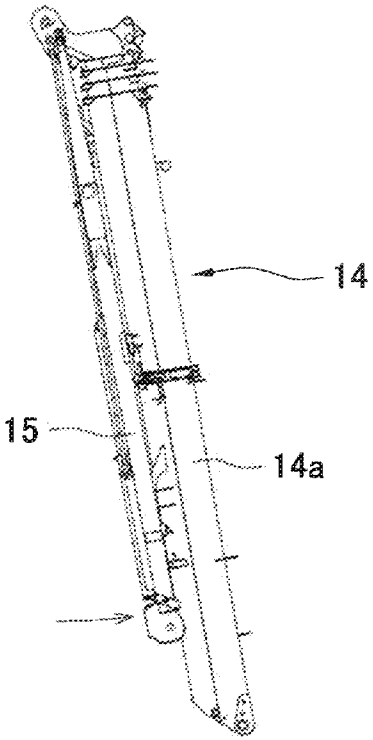
Figure 9A:
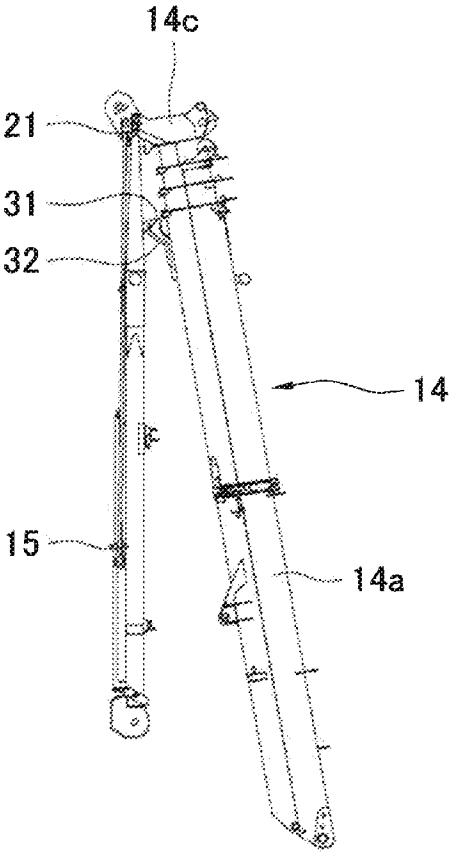

(3) In a step illustrated in FIG. 9A, boom 14 is raised, a hoisting/lowering angle is adjusted to an appropriate angle, and boom 14 is slightly extended. When boom 14 is contracted from this state, guide roller 31 is guided by guide 32, and thereby jib 15 is pulled toward the bottom surface of base end boom 14*a* (FIG. 9B). When boom 14 is further contracted, jib 15 moves along base end boom 14*a*, and first jib support member 40 and second jib support member 50 are connected (FIG. 9C).

(4) Next, boom 14 is lowered. Next, pin 23 is removed from the insertion hole of jib base end engagement portion 22, and jib base end engagement portion 22 and jib connection shaft 21 are disconnected (See FIGS. 2 and 3). Thereupon, jib 15 is brought into a state where jib 15 is supported by first jib support member 40 and second jib support member 50.

(5) Finally, hydraulic cylinder 42 of first jib support member 40 is contracted, and thereby jib 15 is rotated to a storage position from a lower hanging position. Thereupon, as illustrated in FIG. 1, jib 15 is stored along the side surface of boom 14.

Next, based on FIG. 10, step (3) in the above described jib storing work will be described in detail with attention paid to guide member 30, first jib support member 40 and second jib support member 50. In FIG. 10, I, II and III show positions of guide roller 31, pin socket 45, and second pin socket 53 in the respective steps. Alternate long and short dash lines in FIG. 10 show trajectories of guide roller 31, pin socket 45, and second pin socket 53. Respective steps I, II and III in FIG. 10 correspond to respective steps of FIG. 9A, FIG. 9B, and FIG. 9C.

In FIG. 10, I represents a position of guide roller 31 to guide 32 at a time of guide roller 31 being introduced into guide 32 (FIG. 10A), a position of pin socket 45 to jib fixing pin 43 (FIG. 10B), and a position of second pin socket 53 to second auxiliary pin 52 (FIG. 10C). When boom 14 is contracted from the state, guide roller 31 rolls on first raceway surface 34*s* with this. Thereupon, jib 15 is pulled toward the bottom surface of base end boom 14*a*.

As described above, jib 15 that is mounted on a large crane has a long length, and a heavy weight, and therefore has large deflection. In addition a large crane has large play in each part. Furthermore, in a round boom, distal end boom 14*b* easily rotates with respect to base end boom 14*a*. Consequently, even if jib 15 is pulled toward the bottom surface of base end boom 14*a* by guide roller 31 and guide 32, the positions of jib fixing pin 43, and insertion holes 48 and 49 deviate from one another. In order to solve the problem, guide 32 is provided with third raceway surface 36*s*.

In FIG. 10, II represents a position of guide roller 31 to guide 32 at a time of guide roller 31 reaching a top portion of third raceway surface 36*s* (FIG. 10A), a position of pin socket 45 to jib fixing pin 43 (FIG. 10B), and a position of second pin socket 53 to second auxiliary pin 52 (FIG. 10C). Third raceway surface 36*s* is in a protruded shape protruded from second raceway surface 35*s*. Consequently, trajectories of guide roller 31, pin socket 45 and second pin socket 53 form shapes of mountains.

Guide roller 31 rolls on third raceway surface 36*s*, and thereby jib 15 is further pulled toward the bottom surface of base end boom 14*a*. That is, a degree of pulling jib 15 in the case of guide roller 31 being located on third raceway surface 36*s* is larger as compared with that in the case of guide roller 31 being located on second raceway surface 35*s*. Thereby, even if deflection or the like occurs to jib 15, positional deviation of jib fixing pin 43, and insertion holes 48 and 49 can be corrected. Consequently, jib fixing pin 43 can be inserted into insertion holes 48 and 49.

Here, with contraction of boom 14, guide roller 31 passes through third raceway surface 36*s*, before and after the apex of the distal end portion of jib fixing pin 43 passes through front end insertion hole 48. In other words, third raceway surface 36*s* is disposed in a position that satisfies the condition. In the present embodiment, third raceway surface 36*s* is disposed between first raceway surface 34*s* and second raceway surface 35*s*, but the present invention is not limited to this. For example, as long as the condition is satisfied, third raceway surface 36*s* may be provided in an intermediate position of second raceway surface 35*s*.

Immediately before the apex of the distal end portion of jib fixing pin 43 reaches front end insertion hole 48, pin socket 45 is lifted, and positional deviation between jib fixing pin 43 and front end insertion hole 48 is corrected. Consequently, jib fixing pin 43 can be inserted into front end insertion hole 48 without jib fixing pin 43 and front end rib 46 interfering with each other.

Front end insertion hole 48 is a vertical hole. This also can absorb the positional deviation between jib fixing pin 43 and front end insertion hole 48. Consequently, jib fixing pin 43 can be inserted into front insertion hole 48 without jib fixing pin 43 and front end rib 46 interfering with each other.

When boom 14 is further contracted, guide roller 31 rolls on second raceway surface, with this. Thereupon, jib 15 moves along base end boom 14*a* in the state where jib 15 is pulled toward the bottom surface of base end boom 14*a*. At this time, the degree of pulling jib 15 is set so that the center axis of jib fixing pin 43 and the center axes of insertion holes 48 and 49 substantially coincide with one another when jib 15 has no deflection or the like.

Immediately after the apex of the distal end portion of jib fixing pin 43 passes through front end insertion hole 48 in this way, the degree of pulling jib 15 is returned to a normal state. Consequently, positional adjustment of jib fixing pin 43 and insertion holes 48 and 49 can be performed, whether the amount of deflection of jib 15 is large or small. In addition, jib fixing pin 43 and pin socket 45 can be prevented from interfering with each other and exerting an excessively large load.

With contraction of boom 14, the distal end portion of jib fixing pin 43 passes through front end insertion hole 48 first. Thereby, pin socket 45 is roughly positioned. Next, jib fixing pin 43 is inserted into rear end insertion hole 49. An inside diameter of rear end insertion hole 49 is substantially the same as the outside diameter of jib fixing pin 43. Consequently, in a state where jib fixing pin 43 is completely inserted into rear end insertion hole 49, jib fixing pin 43 can be positioned. Further, jib fixing pin 43 can be fixed to pin socket 45.

When boom 14 is further contracted, first auxiliary pin 44 is inserted into first auxiliary insertion hole 46*h*. Subsequently, second auxiliary pin 52 is inserted into second auxiliary insertion hole 54*h*. In this way, jib fixing pin 43, first auxiliary pin 44 and second auxiliary pin 52 are inserted into the respective insertion holes in the mentioned order. In FIG. 10, III represents a position where jib fixing pin 43, first auxiliary pin 44 and second auxiliary pin 52 are completely inserted into the respective insertion holes. From the above, first jib support member 40 and second jib support member 50 are connected.

(Jib Overhanging Work)

Jib overhanging work is performed in the reverse order of the jib storing work. In the jib overhanging work, after jib 15 is disposed in the lower hanging position to connect jib base end engagement portions 22 and jib connection shafts 21, boom 14 is raised, and the hoisting and lowering angle is adjusted at an appropriate angle (FIG. 9C).

Next, boom 14 is extended, and with this, second auxiliary pin 52, first auxiliary pin 44 and jib fixing pin 43 are removed from the respective insertion holes in the mentioned order. Thereby, connection of first jib support member 40 and second jib support member 50 is released (FIG. 9B). When boom 14 is further extended, guide roller 31 rolls on first raceway surface 34*s*, and jib 15 is slowly separated from the bottom surface of base end boom 14*a* (FIG. 9A).

When tilt cylinder 15*c* is extended thereafter, tension rod 15*b* can be caused to generate tension, and jib 15 can be overhung forward with jib connection shaft 21 as center (see FIG. 8).

REFERENCE SIGNS LIST

14 Boom
14*a* Base end boom

15 Jib
30 Guide member
31 Guide roller
32 Guide
34*s* First raceway surface
35*s* Second raceway surface
36*s* Third raceway surface
40 First jib support member
43 Jib fixing pin
45 Pin socket
48 Front end insertion hole
49 Rear end insertion hole
50 Second jib support member

The invention claimed is:

1. A jib overhanging storage mechanism for overhanging/storing a jib with respect to an extendable/contractible boom, the jib overhanging storage mechanism comprising:

a guide roller that is provided at one of the jib and the boom;

a guide that is provided at the other one of the boom and the jib, and guides the guide roller;

a jib fixing pin that is provided at one of the boom and the jib; and a pin socket that is provided at the other one of the jib and the boom, and has an insertion hole into which the jib fixing pin can be inserted, wherein:

the guide has a first raceway surface, a second raceway surface and a third raceway surface on which the guide roller rolls;

the first raceway surface is shaped such that a distal end side of the jib is pulled around a distal end side of the boom as a rotation center toward a bottom surface of the boom by the guide roller rolling thereon with contraction of the boom;

the second raceway surface is shaped flat such that the second raceway surface extends from the first raceway surface and jib moves along the boom in a state where the jib is pulled toward the bottom surface of the boom by the guide roller rolling thereon with contraction of the boom; and the third raceway surface is in a protruded shape protruded in a boundary position between the first and the second raceway surfaces, or an intermediate position of the second raceway surface toward a side of the boom.

2. The jib overhanging storage mechanism according to claim 1, wherein:

the jib fixing pin has a distal end portion formed in a conical shape; and the third raceway surface is located in a position where the guide roller passes before and after an apex of the distal end portion of the jib fixing pin passes through a front end opening portion of the insertion hole, with contraction of the boom.

3. The jib overhanging storage mechanism according to claim 1, wherein the third raceway surface is a surface of a correction plate that is placed on the second raceway surface.

4. The jib overhanging storage mechanism according to claim 1, wherein:

an inside dimension of a front end opening portion of the insertion hole is larger than an outside dimension of the jib fixing pin; and an inside dimension of a rear end opening portion of the insertion hole is substantially a same as the outside dimension of the jib fixing pin.

* * * * *